US006772618B2

(12) United States Patent
Frenken

(10) Patent No.: US 6,772,618 B2
(45) Date of Patent: Aug. 10, 2004

(54) PRESSING TOOL FOR PRESSING PIPE ENDS, AND PRESSING INSERT FOR A PRESSING JAW OF A PRESSING TOOL

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 09/981,404

(22) Filed: Oct. 17, 2001

(65) Prior Publication Data

US 2002/0056308 A1 May 16, 2002

(30) Foreign Application Priority Data

Oct. 19, 2000 (DE) ..... 100 52 071
Feb. 17, 2001 (DE) ..... 101 07 579

(51) Int. Cl.[7] ..... B21D 39/04

(52) U.S. Cl. ..... 72/409.16; 72/409.01; 72/416; 29/237

(58) Field of Search ..... 72/409.16, 409.19, 72/409.01, 402, 453.16, 453.15, 416; 29/237

(56) References Cited

U.S. PATENT DOCUMENTS 2,869,407 A * 1/1959 Swanson ..... 72/453.16
3,575,036 A * 4/1971 Hoffman et al. ..... 72/402
3,706,219 A * 12/1972 Hoffman et al. ..... 72/402
5,148,698 A * 9/1992 Dischler ..... 29/237
5,209,100 A * 5/1993 Dischler ..... 72/409.19
6,044,686 A * 4/2000 Dischler ..... 72/402

* cited by examiner

*Primary Examiner*—Daniel C. Crane
(74) *Attorney, Agent, or Firm*—Trexler, Bushnell, Giangiorgi, Blackstone & Marr, Ltd

(57) ABSTRACT

A pressing tool for pressing pipe ends, and in particular, ends of pipe to be laid for sanitary purposes. The pressing jaws of the tool are connected to one another in an articulated manner, each jaw having an insert that has a circle-like-configuration in the area of interaction between the respective jaws.

16 Claims, 8 Drawing Sheets

PRESSING TOOL FOR PRESSING PIPE ENDS, AND PRESSING INSERT FOR A PRESSING JAW OF A PRESSING TOOL

RELATED/PRIORITY APPLICATION(S)

This application claims priority from German Application No. 10052071.5, filed on Oct. 19, 2000, and German Application No. 10107579.0, filed Feb. 17, 2001.

The invention relates firstly to a pressing tool for pressing pipe ends, in particular ends of pipes laid for sanitary purposes, having pressing jaws which are connected to one another in an articulated manner, it being the case that a pressing jaw has a pressing insert, and has a circle-segment-like configuration in the region of interaction between the pressing jaws and the pressing insert, and the pressing insert can be moved in the circle-circumference direction relative to the pressing jaw, and it also being the case that, during a pressing operation, the pressing inserts come into abutment in first instance at mutually facing first ends, while a movement gap still remains at second ends.

Such pressing tools for pressing pipe ends or the like are known.

In respect of the above-described prior art, it is a technical problem of the invention to develop advantageously a pressing tool of the type in question.

This problem is solved first and foremost by the subject matter of claim 1, this being based on the fact that the pressing tool has two pressing jaws, which supplement one another to form a closed pressing geometry, and that the abutment location of the pressing inserts and the movement gap are formed opposite one another, preferably diametrically opposite one another. This configuration provides a pressing tool which, by means of two pressing jaws, is also suitable for pressing pipe ends of relatively large diameter. This is achieved by the pressing inserts being secured in a floating manner in the two pressing jaws since, as a result, the pressing inserts can be moved in circle-circumference direction relative to the associated pressing jaws. During the pressing operation, the mutually facing first ends of the pressing inserts come into abutment, while, opposite this abutment location, the movement gap forms between the second ends. A preferred arrangement of two pressing inserts provides that the abutment location of the pressing inserts and the movement gap are aligned diametrically opposite one another on an axis of symmetry of the pressing jaws, which supplement one another to form a closed pressing geometry. It is also preferred for the movement gap to form between the second ends of the pressing inserts of a pressing-tool articulation formation connecting the pressing jaws. Correspondingly, those ends of the pressing inserts which are located opposite the articulation come into abutment. Alternatively, however, it is also possible for the inserts to abut in the region of the articulation formation, in which case the movement gap then remains opposite this articulation formation. It is also preferred for each pressing jaw to be assigned a pressing insert which can be moved in the circle-circumference direction. A pressing implement, for example a hydraulic pressing implement, advantageously acts on the pressing-jaw free ends, which are located opposite the articulation formation, the pressing inserts, further preferably, being secured in the pressing jaws, in an unloaded basic position, such that they project beyond the free end surfaces of the pressing jaws by way of their first, mutually facing ends, so that these free ends come into abutment first during the pressing operation. As the pressing operation progresses, the pressing inserts, which are supported on one another in the region of the first ends, move relative to the pressing jaws, which results in the movement gap, which is located opposite the abutment location, being closed.

The invention also relates to a pressing tool for pressing pipe ends, in particular ends of pipes laid for sanitary purposes, having pressing jaws which are connected to one another in an articulated manner, it being the case that a pressing jaw has a pressing insert, and is of circle-segment-like configuration in the region of interaction between the pressing jaw and the pressing insert. In order for a pressing tool of the type in question to be developed advantageously, it is proposed that the pressing inserts are secured by latching in an operationally releasable manner. It is thus advantageously possible for the pressing inserts to be released from the pressing jaws extremely easily, if appropriate, without any tools, but at least without any special tools, it further being possible for each pressing insert to be exchanged individually. It proves to be particularly advantageous here that the pressing inserts can be released without the latching securing means being dismantled and, furthermore, also without the latching elements being released, for example unscrewed. This configuration according to the invention makes it possible for the pressing inserts to be changed extremely easily, preferably without the use of tools. In this respect, it is further proposed that provided for securing purposes are two pins which, oriented radially inward on a pressing jaw and on a radial line, project inward beyond the pressing jaw, are spaced apart from one another in the direction of the circle, engage in associated bores of the pressing inserts, and of which at least one can be moved out of the pressing insert for removal of the same. The pressing insert can be moved out in the radial direction, for example, by means of a handle which is connected to a first pin. Furthermore, hand-actuated pivoting of the first pin out of the latching securing means is also conceivable. In addition, a preferred configuration of the subject matter of the invention provides that, in the case of a pressing tool with two pressing jaws, which supplement one another to form a closed pressing geometry, the two pins arranged in each pressing jaw each enclose an acute angle in relation to the associated end side directed towards the end side of the other pressing jaw, so, further preferably, an angle of 15–45°. It also proves to be particularly advantageous that this securing means according to the invention can serve both for the latching accommodation of a fixed pressing insert and for the latching accommodation of a floating pressing insert, i.e. one which can be moved in the circle-circumference direction relative to the pressing jaw, for which purpose, if the latter are used, these have bores for the latching pins which allow the desired capacity for movement, for example bores, the diameters of which are greater than, for example double the size of, the pin diameter, or slot-like bores. The above-described features prove to be advantageous both individually and in combination. It is thus further proposed that the movement gap first of all remains in the region of an articulation connection of the pressing jaws, i.e. opposite the side on which the pressing tool acts on the pressing jaws. It is alternatively proposed, in this respect, that the movement gap first of all remains in the region of the unconnected ends of the pressing jaws, i.e. in the region where the pressing tool acts on the pressing jaws. The pressing jaws may be formed here as pressing members which can be released, at least in part, from the pressing tool. In this respect, it is further alternatively proposed that the pressing jaws are formed in mouth sections of the tong legs of the pressing tool. As a result, single-piece configuration of the pressing jaws and tong legs is selected, which pressing jaws are formed for accommodating pressing inserts. The tong legs of the pressing tool are usually connected in an articulated manner by means of link plates. In this respect, it is proposed, in a development of the subject matter of the invention, that the first pin, which can be moved out of the pressing insert, is disposed in the mouth opening remote from the link plates. Alternatively, it is also possible for this first pin, which effects the release of the pressing insert, to be disposed in that end region of the pressing jaw which is directed towards the link plates. It is also proposed that a second pin, which cannot be moved out, is disposed in the region of the link plates, it also being possible for this second pin, according to the above-described alternative, to be positioned in that region of the pressing jaw which is remote from the link plates. It is additionally provided that the second pin, which cannot be moved out, is secured for rotary articulation in the pressing jaw, the longitudinal axis of the pin sassing through the rotary articulation. In the closed position, i.e. in the pressing position, the rotary-articulation axis preferably extends parallel to the pressing-mouth axis formed in the region of the pressing jaws and/or of the pressing inserts. In order to ensure the specified rocking mounting of the insert which is to be accommodated in the pressing jaw, it is provided that the second pin passes through a circumferentially extending slot of the pressing jaw. In this respect, it is also proposed that the second pin is spring-prestressed against one end of the slot. For removing the pressing insert from the pressing jaw, the first pin can be moved out of the associated bore or engagement opening of the pressing insert. For this purpose, the first pin may have a handle, for displacing the first pin in the axial direction counter to a spring force, thus, for example, by the first pin being displaced back with pulling action in the radial direction, in relation to the pressing-insert extent. Alternatively, it is proposed that the first pin is formed on a rocker, which rocker is formed as a handle. In this respect, it is further proposed that that end of the rocker which is directed away from the first pin is spring-supported in the pressing jaw, for automatically displacing the first pin back into the engagement position.

The invention also relates to a pressing insert for a pressing jaw of a pressing tool for pressing pipe ends, it being the case that the pressing insert is of a circle-segment-like configuration. In order to develop advantageously such a pressing insert as far as its properties are concerned during the pressing operation, it is proposed that the pressing insert, on the inside, has a section of first curvature and a tongue-like section of second curvature which, in the unloaded state, projects inwards, at its end in any case, beyond the section of first curvature. This configuration according to the invention gives pressing inserts which make it possible, using a pressing tool with two pressing jaws and two associated pressing inserts, to carry out pressing operations with nominal widths of over 50. For the purpose of carrying out pressing operations with nominal widths of over 50, the prior art includes pressing tools which have three or more pressing jaws and/or pressing inserts. Furthermore, the configuration of the pressing insert according to the invention gives the advantageous effect that, during the pressing operation, the tongue-like section of second curvature, upon reaching a pressing force of, for example, 500 kg, is displaced into the deflected position following the first curvature, and that, when the action of force is released, the spring-back of the tongue-like section of second curvature causes the pressing insert to lift off from the blank.

The invention also relates to a pressing insert for a pressing jaw of a pressing tool for pressing pipe ends, it being the case that the pressing insert is of circle-segment-like configuration. In order to develop advantageously here, in particular in handling terms, a pressing insert of the type in question, it is proposed that the pressing insert has two engagement openings which are offset over the circumference and are intended for securing pins. As a result of this configuration according to the invention, the pressing insert can be secured by latching, in pressing jaws of a pressing tool, in an operationally releasable manner. The above-described features of the pressing insert according to the invention are advantageous both individually and in combination. An advantageous development of the subject matter of the invention thus provides that the tongue-like section of second curvature is cut out of the section of first curvature, the tongue tip, furthermore, being disposed eccentrically in relation to a circumferential extent of the pressing insert. Furthermore, the tongue-like section has a width which is less than the width of the pressing insert. As a further alternative, or in combination with the above-described solution, it may be provided that the pressing insert has two engagement openings which are offset over the width and are intended for securing pins. A preferred configuration here is one in which the engagement openings are formed mirror-symmetrically in relation to a circumference bisector. The engagement openings may be in the form of bores or slot-like bores. It is preferred here, however, for one or both of the engagement openings to be blind bores.

The invention is explained in more detail hereinbelow with reference to the attached drawing, which merely illustrates exemplary embodiments and in which.

Figure 1:
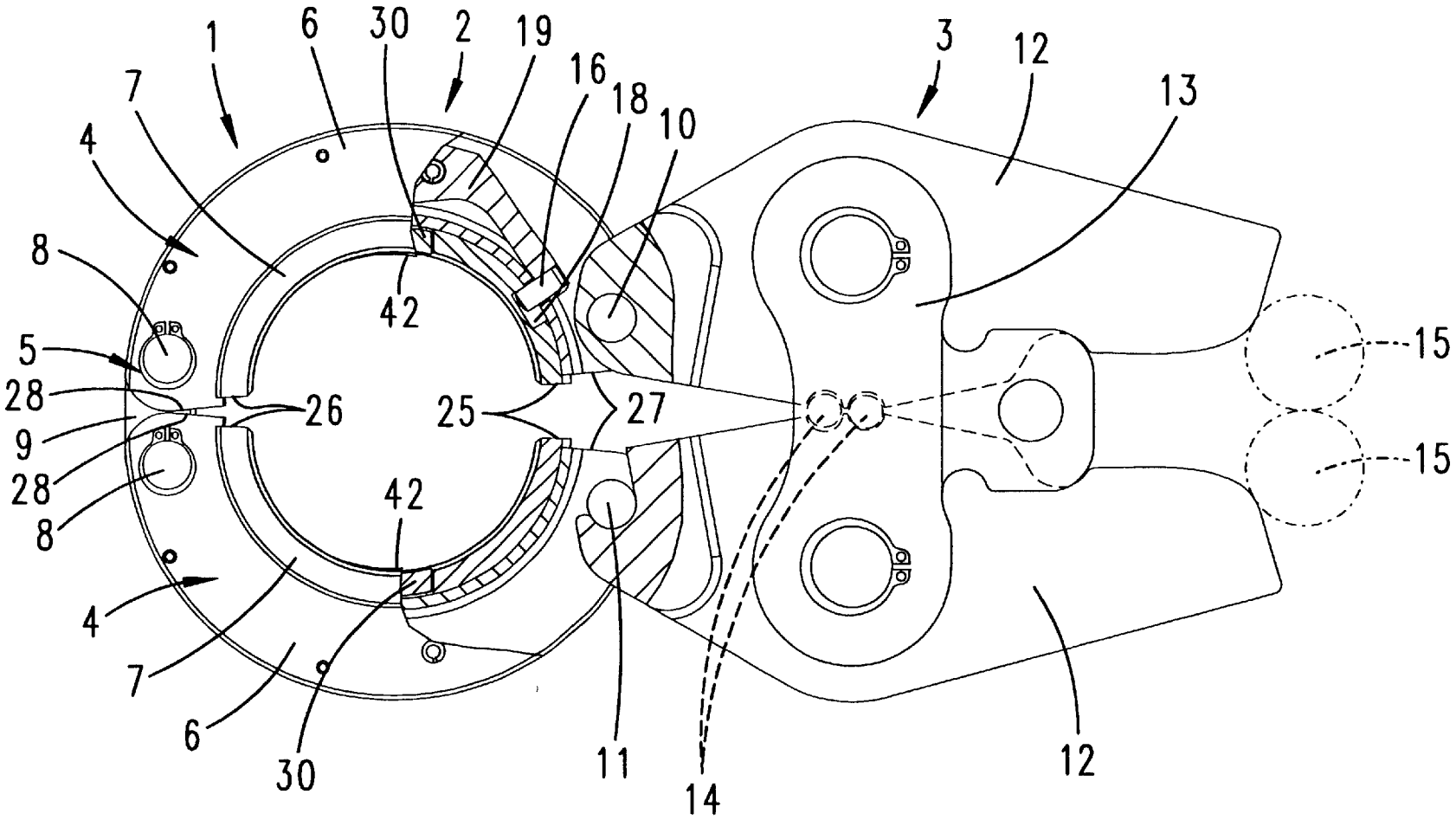
FIG. 1 shows a partially sectioned illustration of a pressing tool according to the invention.
Figure 2:
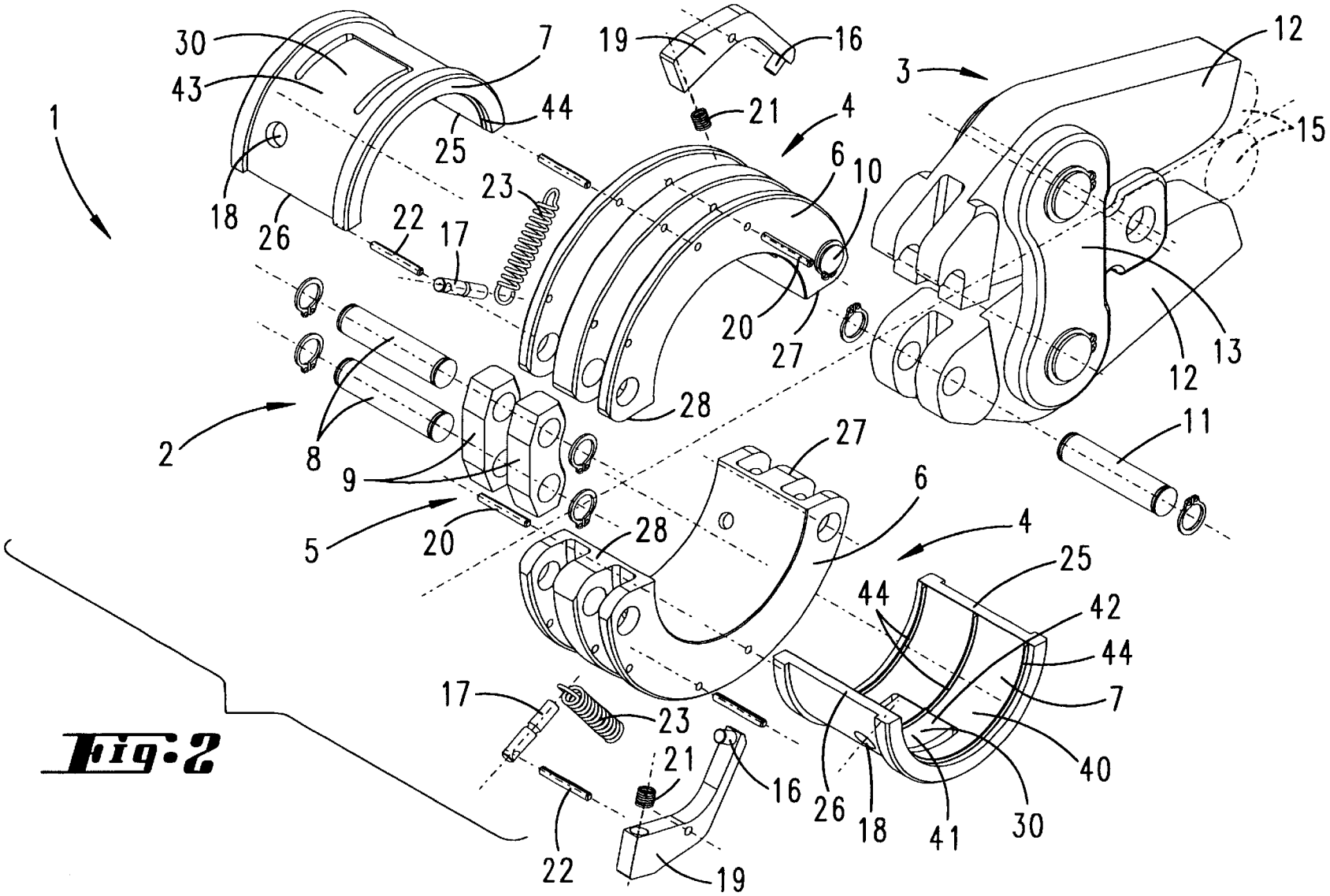
FIG. 2 shows an exploded illustration, in perspective, of the pressing tool.

A pressing tool 1, which is made up substantially of a die 2, and a clamping arrangement 3, will be illustrated and described first of all with reference to FIG. 1. The die 2 substantially comprises two identical pressing members 4 which are connected to one another via an articulation formation 5 at one end.

Each pressing member 4 substantially comprises two circle-segment-like semicircular pressing jaws 6, i.e. ones which supplement one another to form a closed pressing geometry, and pressing inserts 7 which are secured via these pressing jaws 6.

The articulation formation 5 is achieved in each case by an articulation bolt 8 which passes through a free end of a pressing jaw 6, a pivotable connection of the pressing jaws 6 being achieved, via these articulation bolts 8, by means of link plates 9.

At the ends which are located opposite the articulation formation 5, the pressing jaws 6 have, likewise transversely to the circle-segment extent thereof, bolts 10, 11 which pass through the pressing jaws 6.

The clamping arrangement 3 substantially comprises two tong legs 12, which are connected by link plates 13. One tong leg 12 here is connected to the bolt 10 of the die 2, for which purpose that end of the tong leg 12 which is associated with the die 2 fully encloses the bolt 10. The other tong leg 12, on the other hand, is open in semicircular form for accommodating the other bolt 11, so that straightforward assembly by hooking in is made possible.

Provided between the tong legs 12, in the region of the link plates 13 connecting the same, are cylindrical pins 14, which ensure a more or less symmetrical closing movement of the tong legs 12.

The closing movement is effected by a drive, of which only the cam rollers 15 are illustrated, such that the cam rollers 15 advance inwards against the cam paths, which are formed on the inside of the tong legs 12, in order to spread apart the tong-leg ends on this side. As a result, the leg ends which act on the bolts 10 and 11 of the die 2 are moved towards one another.

The two pressing jaws 6, which are disposed and formed mirror-symmetrically, bear, on the inside, circle-segment-like pressing inserts 7 which are adapted to the blank. These pressing inserts are secured by latching in a form-fitting manner in the pressing jaws 6 by pins 16, 17 which are spaced apart from one another in the direction of the circle (see, for example, FIG. 8).

Figure 12:
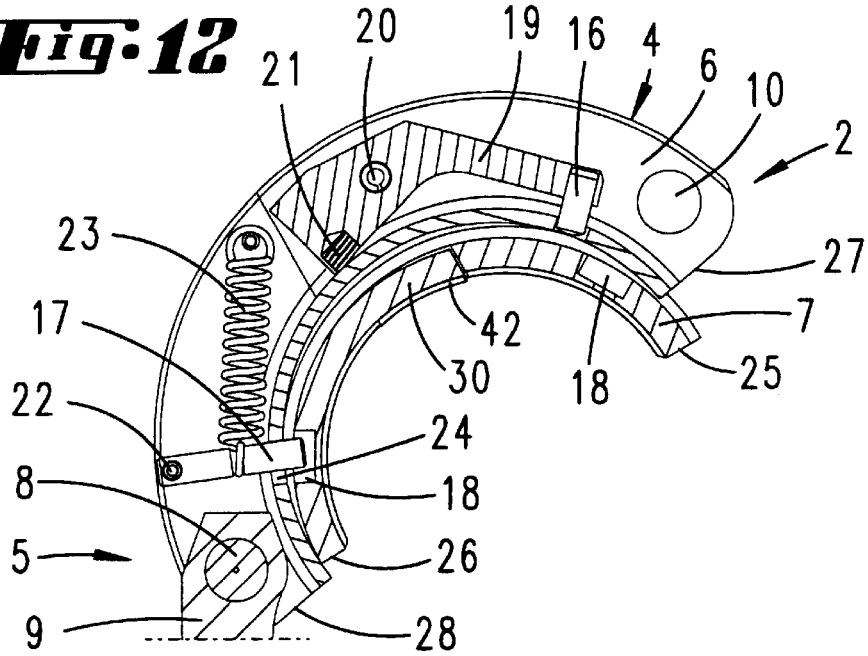
FIG. 12 shows an illustration in detail form of an upper pressing jaw, illustrating the removal position of the associated pressing insert.
Figure 11:
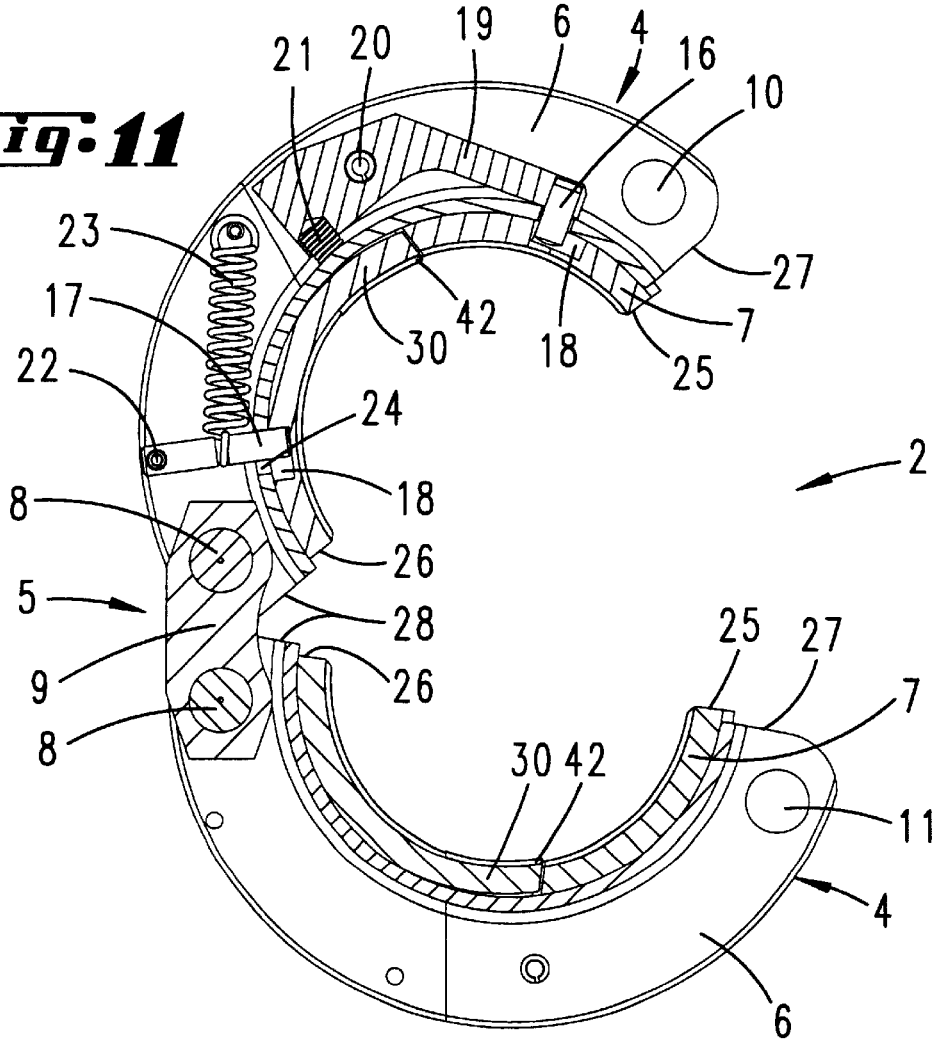
FIG. 11 shows an illustration corresponding to FIG. 8, but with the pressing tool open.

These pins 16, 17 of each pressing jaw 6 are each oriented on a radial line and project radially inwards into the pressing-insert region. The pressing insert 7 has correspondingly associated engagement openings 18 which are offset mirror-symmetrically both over the circumference and over the width and in which the pins 16, 17 engage. In order to remove a pressing insert 7, a first pin 16 can be moved out of the associated engagement opening 18 of the pressing insert 7, for which purpose this first pin 16, which is in the region of the link plates 13 of the clamping arrangement 3, can be pivoted, via a hand-actuatable rocker 19, about a pin 20 which is aligned transversely to the circle extent of the pressing jaw 6. This rocker 19, which is disposed pivotably in the pressing jaw 6, is prestressed into the basic position, i.e. into the latching position, counter to a compression spring 21. Furthermore, the rocker 19 can be actuated radially from the outside. As can be gathered from FIG. 12, following actuation and the associated first pin 16 being displaced back as a result, the pressing insert 7 can be removed extremely easily from the pressing jaw 6.

The second pin 17, which is remote from the link plates 13 of the clamping arrangement, may be formed in a fixed manner in order to achieve such a securing means. The solution shown here, however, has the possibility both of accommodating a fixed pressing insert 7, i.e. one which cannot be moved in relation to the pressing jaw 6, according to FIG. 13, and of securing a floating pressing insert 7, i.e. one which can be moved in the circle-circumference direction relative to the pressing jaw 6, according to the exemplary embodiment in FIGS. 1 to 12. For this purpose, the second pin 17 is disposed for rotary articulation about a pin 22, secured in the pressing jaw 6, and is prestressed into its basic position according to FIG. 8 by means of a tension spring 23. In order to ensure that the second pin 17 can pivot, the through-passage opening inside the pressing jaw 6 which is directed towards the pressing insert 7 is formed correspondingly, for example in the form of a circumferentially extending slot 24.

Figure 13:
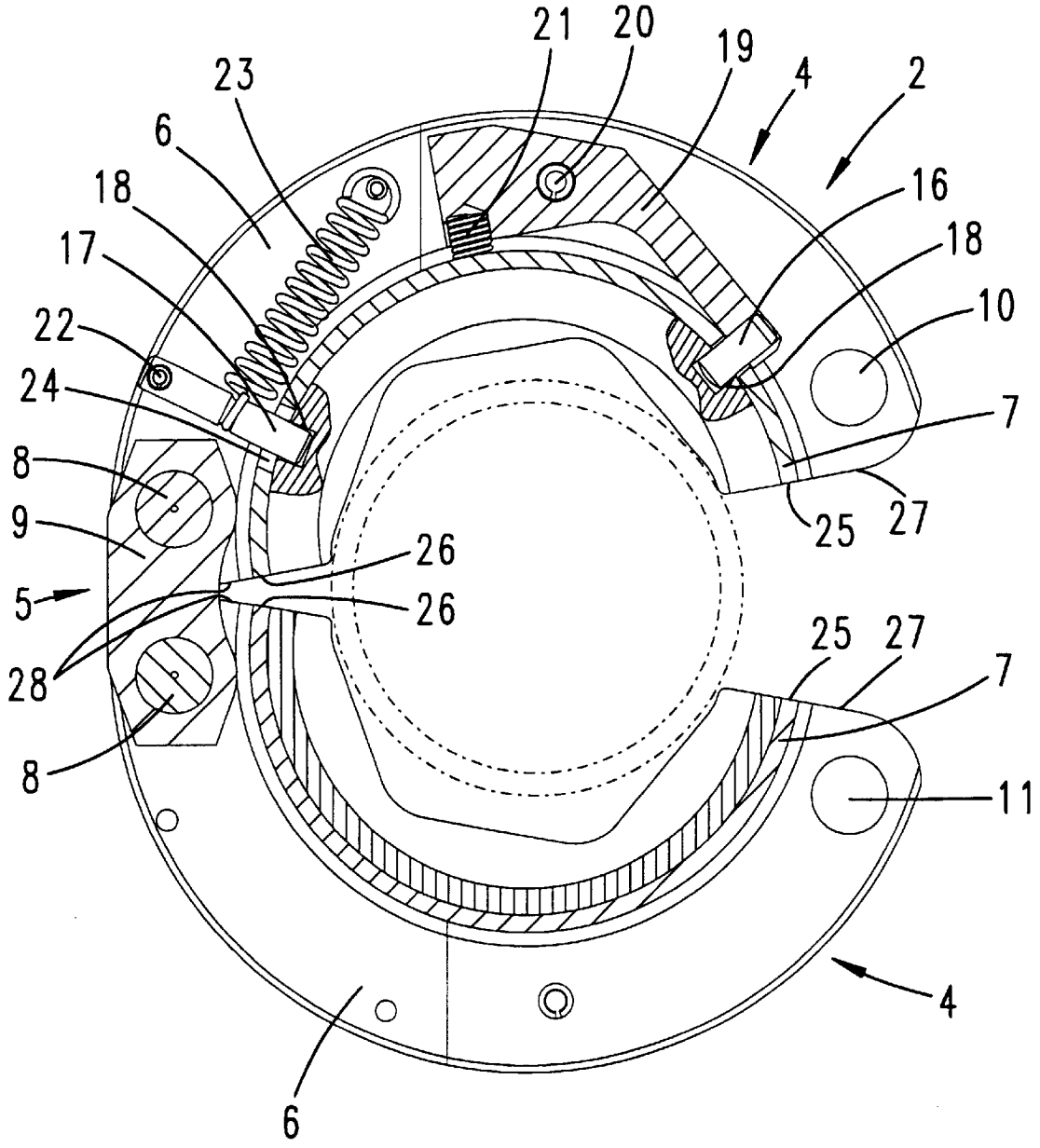
FIG. 13 shows an illustration corresponding to FIG. 8, but with a second embodiment of pressing inserts being used.

When use is made of a fixed pressing insert 7 according to FIG. 13, engagement openings 18 which are intended for accommodating the pins 16, 17 and the diameters of which are adapted to the pin diameters, are provided in the pressing inserts 7. These engagement openings 18 are positioned in the pressing inserts 7 such that the end surfaces of the free ends 25, 26 of the pressing inserts are aligned with the end surfaces 27, 28 of the pressing jaw 6. As a result of the configuration according to the invention, it is possible here to use pressing inserts 7 with nominal widths of over 50, preferably of over 60.

Irrespective of whether the pressing inserts 7 are formed in a floating or fixed manner, the engagement openings 18 are formed as blind bores.

In the case of pressing inserts 7 being mounted in a floating manner, the engagement openings 18 are formed such that the pressing insert 7 can be displaced in the circle-circumference direction. It is thus possible for these engagement openings 18 to be formed for example, as blind slot-like bores. It is also conceivable, however, merely to select the diameter of the engagement openings 11 to be greater than the pin diameters. According to the exemplary embodiment illustrated, the bore size selected allows displacement in the circle-circumference direction by approximately one pin diameter.

Figure 8:
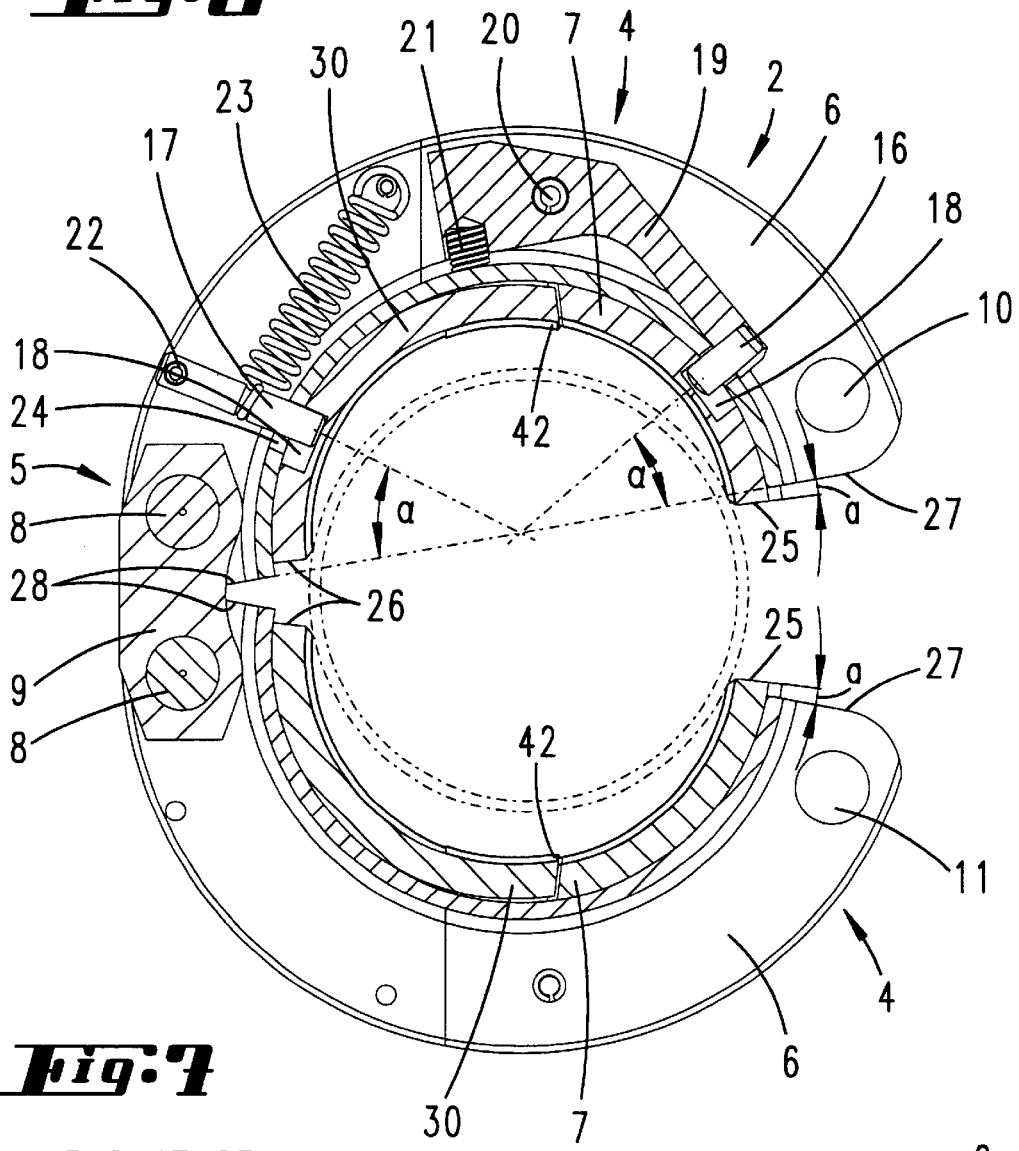
FIG. 8 shows the section along the line VIII—VIII in FIG. 7, illustrating the open, unloaded basic position of the pressing tool.
Figure 7:
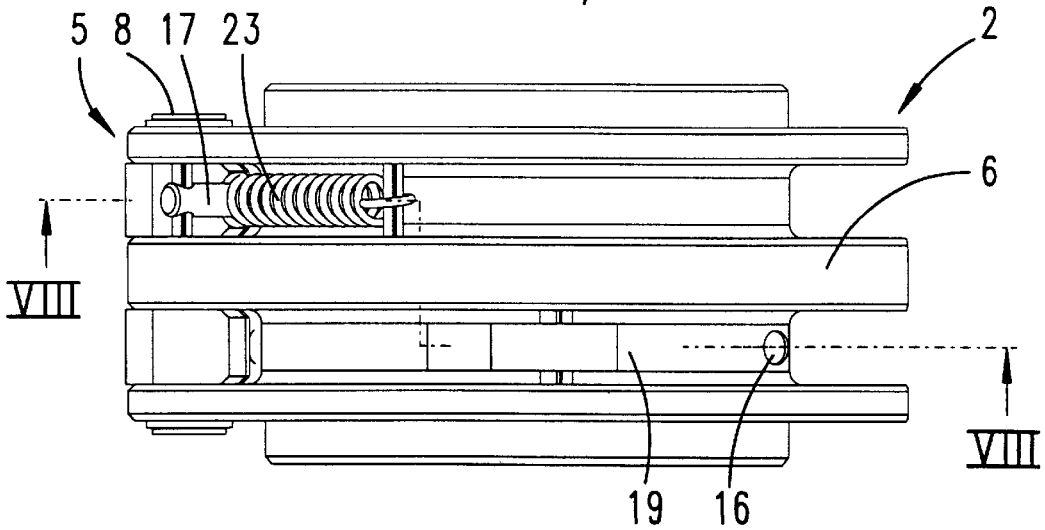
FIG. 7 shows the plan view of the pressing tool, with the clamping arrangement acting on the pressing jaws thereof omitted.

In an unloaded basic position according to FIG. 8, the first, mutually facing free ends 25 of the pressing inserts 7 project beyond the associated end surfaces 27 of the free ends of the pressing jaw 6, which are located opposite the articulation formation 5, this offset distance a being determined by the spring-forced action of the second pin 17 in the region of the engagement opening 18 and simultaneous blocking support of the other engagement opening 18 on the first pin 16.

Since the pressing inserts 7 are each of semicircular configuration in order to achieve a full pressing geometry, they are offset to the rear in the region of the second ends 26 in relation to the associated end surfaces 28 of the pressing jaw 6.

Furthermore, the pins 16 and 17 are positioned such that their pin axes enclose an acute angle alpha in relation to the associated end surfaces 27, 28, which angle alpha, in the exemplary embodiment illustrated, is 30°.

During a pressing operation, first of all the first ends 25 of the pressing inserts 7 come into abutment in the region of the gap which is still left between the end surfaces 27 of the pressing jaw 6, while a movement gap 29 still remains at the second, diametrically opposite ends 26, which are associated with the articulation formation 5. Until this intermediate pressing position has been reached, the pressing inserts 7 remain in their basic position, i.e. in their position in which they are not displaced in relation to the associated pressing jaws 6. It is only as the pressing operation progresses that the abutment of the ends 25 effects a relative displacement of the pressing inserts 7 in the circle-circumference direction, with the second pin 17, which is loaded via the tension spring 23, being carried along in the process.

Figure 10:
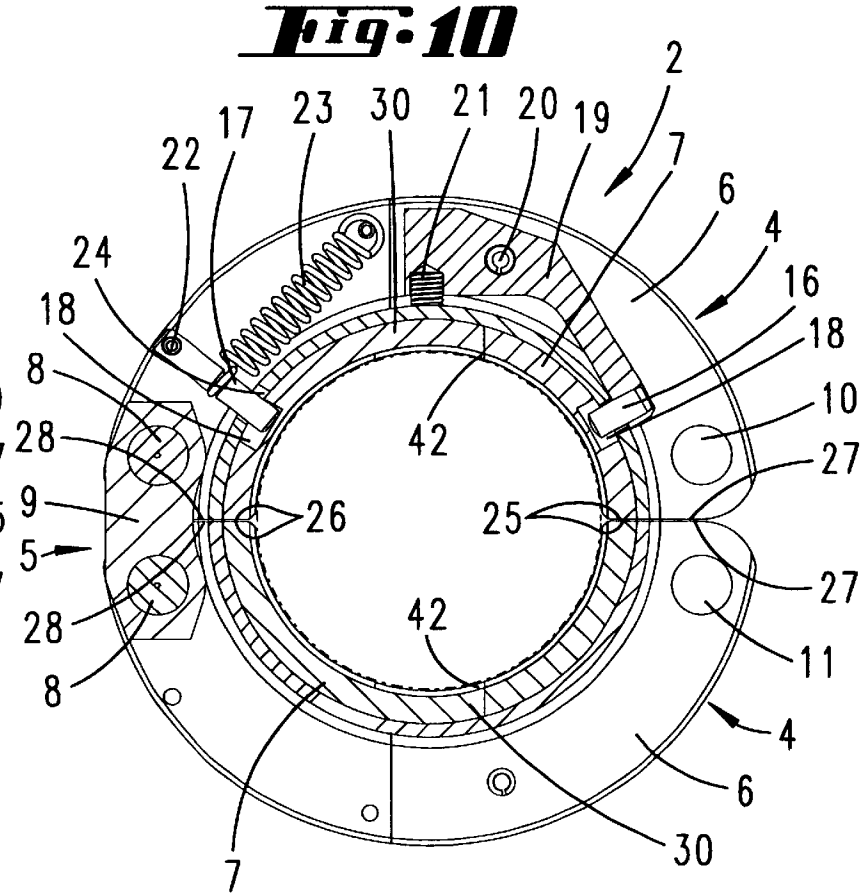
FIG. 10 shows a further follow-up illustration, with the pressing operation completed.
Figure 9:
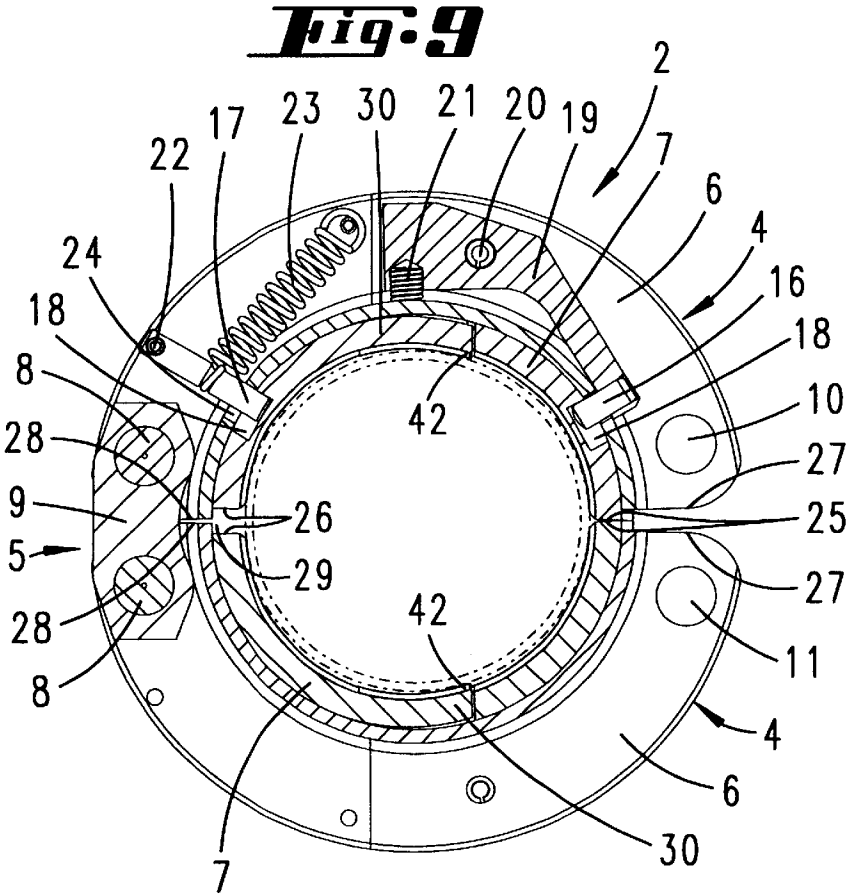
FIG. 9 shows a follow-up illustration to FIG. 8 during a pressing operation.

In the pressing position according to FIG. 10, both the ends 25 and the ends 26 of the pressing inserts 7 butt against one another.

When the die 2 is opened, the pressing inserts 7, which may possibly subject the blank to a clamping action, are carried along via the pins 16, 17, the size of the bores 18 in the pressing inserts 7 being selected such that no overrunning of either of the pins 16 and 17 is possible in any circle-circumference position of the pressing inserts 7. It is always the case that bore-wall sections are supported on the associated pins 16 and 17.

Figure 4:
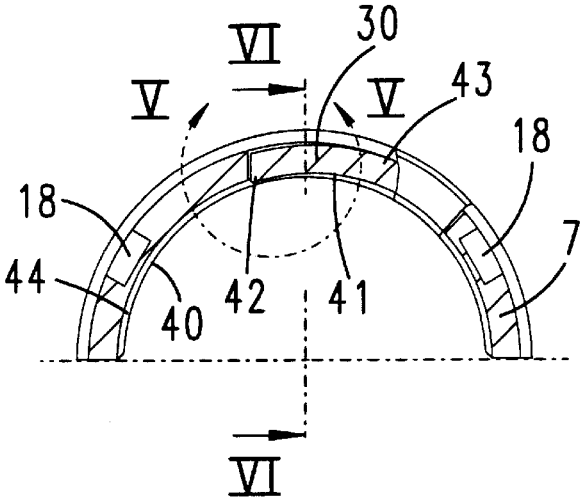
FIG. 4 shows the section along the line IV—IV in FIG. 3.
Figure 6:
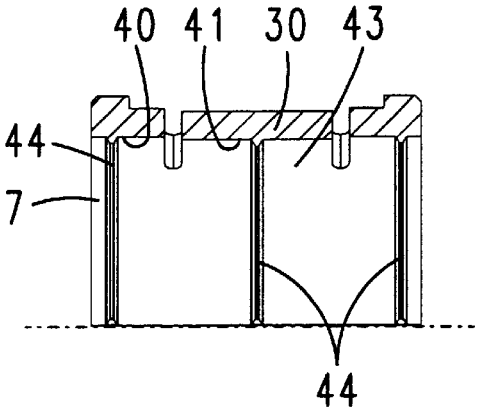
FIG. 6 shows the section along the line VI—VI in FIG. 4.
Figure 3:
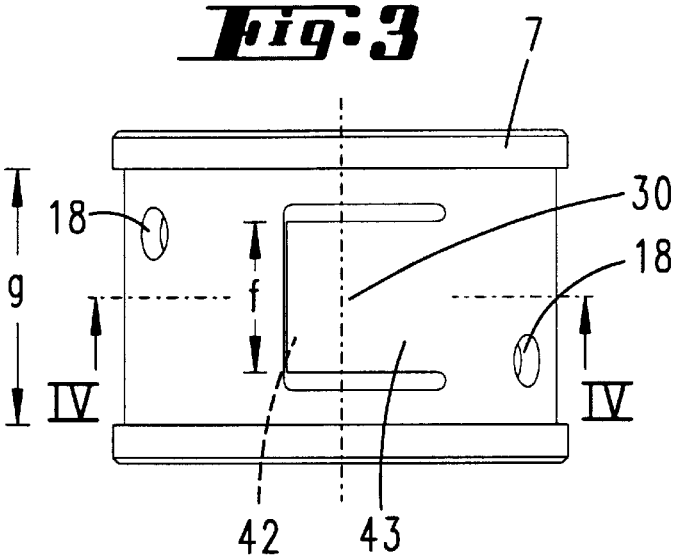
FIG. 3 shows a view of a pressing insert of the pressing tool.
Figure 5:
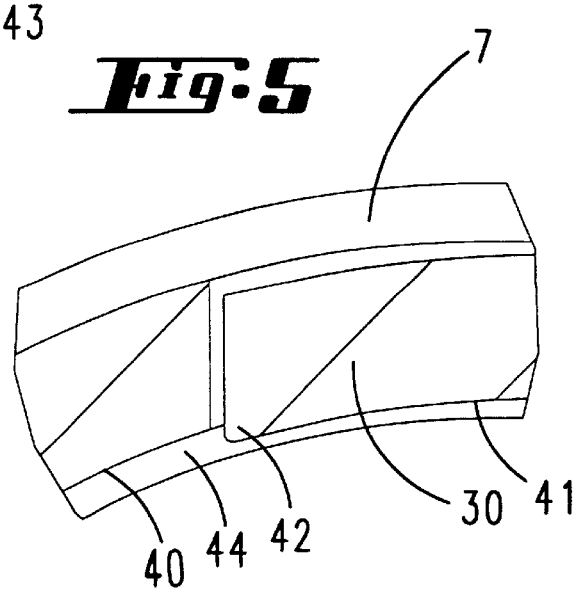
FIG. 5 shows an enlargement, in detail form, of the region V—V in FIG. 4.

Both the pressing properties and the release of the pressing inserts 7 from the blank may be further improved by a resilient tongue 30 of the pressing inserts 7. FIGS. 3 to 5 show a pressing insert 7 on its own. The pressing insert 7, on the inside, has a section 40 of first curvature and a section 41 of second curvature which, in the unloaded state, projects inwards, at its end in any case, by approximately 13 mm beyond the section 40 of first curvature, which section 41 of second curvature is cut out of the section 40 of first curvature in order to form the tongue 30.

As can be seen from FIG. 4, the resulting tongue tip 42, which projects inwards at its end, is disposed eccentrically in relation to the circumferential extent of the entire pressing insert 7, with the tongue 30 as a whole disposed centrally, so that, in relation to a circumference bisector of the pressing insert 7, a tongue root 43 is positioned symmetrically to the tongue tip 42. The circurferentially measured length of the tongue 30 corresponds approximately to a third of the circumferential length of the pressing insert 7. With the tongue 30 disposed centrally, as seen transversely to the circumferential direction, it has, in the same direction, a width f which is approximately two thirds to three quarters of the width g of the section 40 of first curvature.

Additionally formed on the inner wall of the pressing insert 7, in order to improve the pressing properties, are three mutually parallel ribs 44 which extend, in the circumferential direction of the pressing insert 7, both over the section 40 of first curvature and over the section 41 of second curvature (tongue 30).

During the pressing operation, which takes place, for example, with 20 tons, the resilient portion 30, for example when a pressing force of 500 kg has been reached, is displaced into the deflected position following the general circle-segment form of the pressing insert 7, and thus does not have a disruptive effect on the actual pressing operation. Once the action of force has been released, the spring-back action of the portion 30 causes the pressing insert 7 to lift off from the blank.

Figure 14:
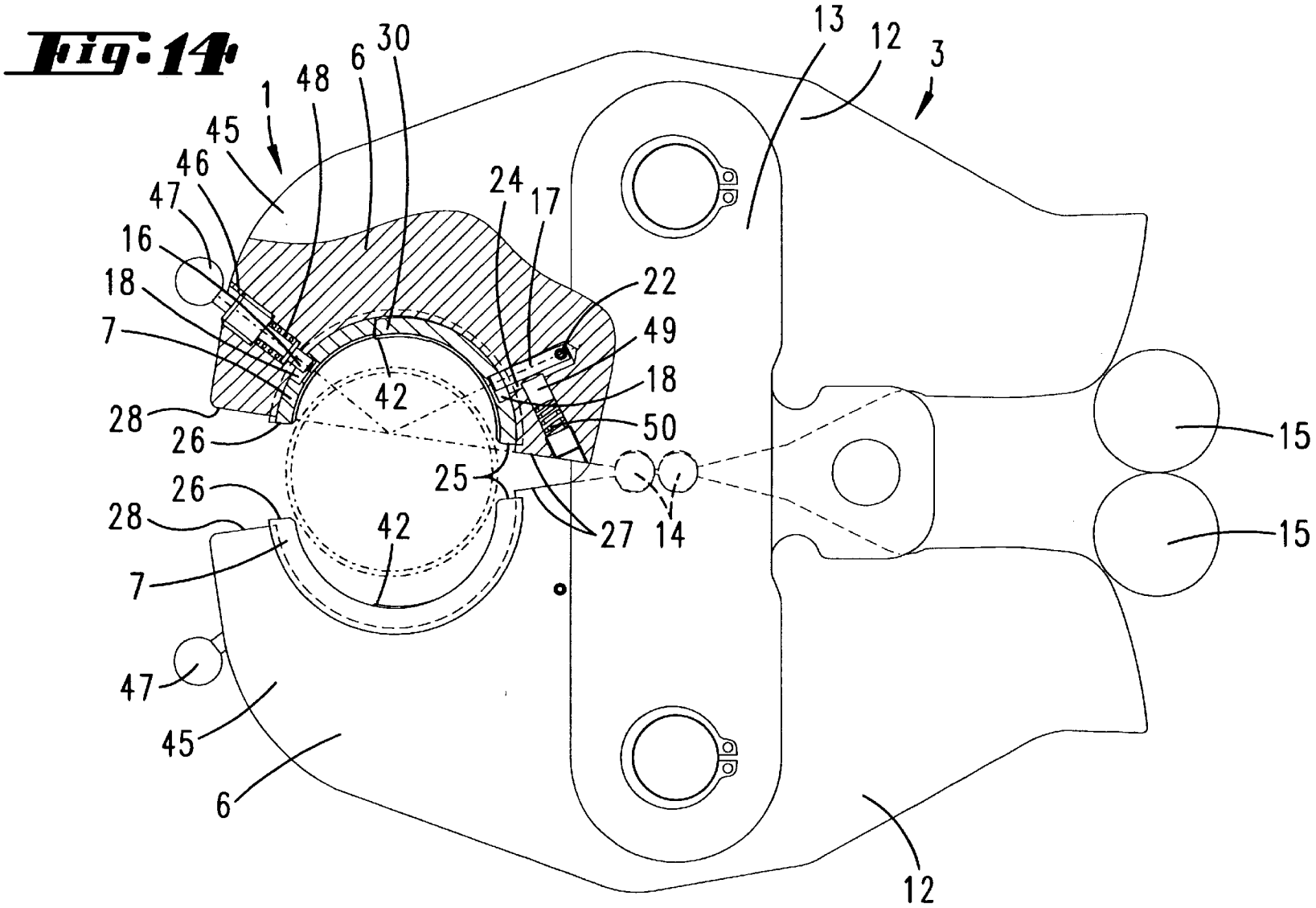
FIG. 14 shows an illustration corresponding to FIG. 1, relating to a further embodiment.

FIG. 14 shows an alternative embodiment of a pressing tool 1 according to the invention, in which the pressing jaws 6 are formed in mouth sections 45 of the tong legs 12, which extend beyond the link plates 13. This forms a tong-like pressing tool 1, the pressing jaws 6 of which are disposed and formed mirror-symmetrically. The latter bear, on the inside, pressing inserts 7 which are adapted to the blank. These pressing inserts are secured by latching in a formfitting manner in the pressing jaws 6 by pins 16, 17 which are spaced apart from one another in the direction of the circle.

According to the first exemplary embodiment, these pins 16, 17 of each pressing jaw 6 are each oriented on a radial line and project radially inwards into the pressing-insert region.

In contrast to the above-described exemplary embodiment, in the embodiment according to FIG. 14, the first pin 16, which can be moved out of the associated engagement opening 18 in order to release the pressing insert 7, is disposed in the mouth opening, formed between the pressing jaws, of the pressing jaw 6 remote from the link plates. Accordingly, the second pin 17, which cannot be moved out, is disposed in the mouth opening in the region of the link plates.

The first pin 16 passes, along its longitudinal extent, through an outwardly oriented bore 46. That end of the pin 16 which projects freely outwards out of this bore is provided with a handle 47, for displacing the pin 16 back along its longitudinal axis. The pin 16 is prestressed into the engagement position via a compression spring 48.

According to the first embodiment, the second pin 17 is disposed for rotary articulation. In the exemplary embodiment shown in FIG. 14, the pin 17 is prestressed into its basic position by means of a compression-spring-assisted pressure-exerting pin 49 which acts approximately transversely to the longitudinal axis of the pin 27. The compression spring which effects the spring prestressing is provided with the reference numeral 50.

The pressing inserts 7 illustrated correspond to those of the above-described exemplary embodiment.

The fact that the sins 16 and 17 are disposed differently to those in the first exemplary embodiment means that, in a basic position according to FIG. 14, in this case the second, free ends 26 of the pressing inserts 7, which are remote from the link plates, project beyond the associated end surfaces 28 of the free ends of the pressing jaw 6, which are remote from the link plates, an offset distance also being determined here by the spring-forced action of the second pin 17 in the region of the engagement opening 18 and the simultaneous blocking support of the other engagement opening 18 on the first pin 16.

During a pressing operation, in this exemplary embodiment, first of all the second ends 26 of the pressing inserts 7 come into abutment, while a movement gap still remains at the diametrically opposite ends 25, which are in the region of the link plates. Until this intermediate pressing position has been reached, the pressing inserts 7 remain in their basic position. It is only as the pressing operation progresses that the abutment of the ends 26 effects relative displacement of the pressing inserts 7 in the circle-circumference direction, with the pin 17, which is loaded via the spring-forced pressure-exerting pin 49, being carried along in the process.

All features disclosed are (in themselves) pertinent to the invention. The disclosure contents of the associated/attached priority documents (copy of the prior application) are hereby also included in full in the disclosure of the application, also for the purpose of incorporating features of these documents in claims of the present application.

What is claimed is:

1. A pressing tool for pressing pipe ends, in particular ends of pipes laid for sanitary purposes, said pressing tool comprising:

pressing jaws which are connected to one another by an articulated connection, each said pressing jaw having a circle-segment-like configuration in a region of interaction between said pressing jaws, said pressing jaws supplementing one another to form a closed pressing geometry; and pressing inserts capable of being inserted into said circle-segment-like configurations of said pressing jaws and interacting with said pressing jaws in said region of interaction, said pressing inserts having mutually facing first ends and mutually facing second ends, said pressing inserts capable of being moved in a circle-circumference direction relative to said pressing jaws, whereby, during a pressing operation, when said mutually facing first ends of said pressing inserts abut one another, a movement gap remains between said mutually facing second ends such that said mutually facing first ends abut one another prior to said mutually facing second ends of said pressing inserts abutting one another, said movement gap being opposite to said mutually facing first ends.

2. A pressing tool as defined in claim 1, wherein said movement gap is provided proximate to said articulation connection of said pressing jaws.

3. A pressing tool as defined in claim 1, wherein said pressing tool further comprises tong legs having mouth sections, said pressing jaws being formed in said mouth sections of said tong legs.

4. A pressing tool as defined in claim 3, wherein said tong legs are connected to one another by at least one link plate.

5. A pressing tool as defined in claim 4, wherein said pressing inserts have bores therein, and wherein said pressing tool further comprises first and second pins, said first and second pins being oriented radially inwardly on said pressing jaws and on a radial line, said first and second pins projecting inwardly beyond said pressing jaws, said first and second pins being spaced apart from one another in said circle circumference direction, said first and second pins being engaged in said bores of said pressing inserts for securing said pressing inserts to said pressing jaws, at least one of said first and second pins capable of being moved out of engagement with said pressing inserts to allow for removal of said pressing inserts from said pressing jaws.

6. A pressing tool as defined in claim 5, wherein said first pins are capable of being moved out of engagement with said pressing inserts and are positioned within said mouth sections of said tong legs remote from said at least one link plate.

7. A pressing tool as defined in claim 5, wherein said second pins are incapable of being moved out of engagement with said pressing inserts and are positioned within said mouth sections of said tong legs proximate to said at least one link plate.

8. A pressing tool as defined in claim 5, wherein said second pins pass through circumferentially extending slots of said pressing jaws.

9. A pressing tool as defined in claim 8, wherein said second pins are spring-prestressed against one end of said slots.

10. A pressing tool as defined in claim 1, wherein said pressing inserts have bores therein, and wherein said pressing tool further comprises first and second pins, said first and second pins being oriented radially inwardly on said pressing jaws and on a radial line, said first and second pins projecting inwardly beyond said pressing jaws, said first and second pins being spaced apart from one another in said circle circumference direction, said first and second pins being engaged in said bores of said pressing inserts for securing said pressing inserts to said pressing jaws, at least one of said first and second pins capable of being moved out of engagement with said pressing inserts to allow for removal of said pressing inserts from said pressing jaws.

11. A pressing tool as defined in claim 10, wherein said second pins are secured for rotary articulation in said pressing jaws, a longitudinal axis of said second pins passing through said rotary articulation.

12. A pressing tool as defined in claim 10, wherein said second pins pass through circumferentially extending slots of said pressing jaws.

13. A pressing tool as defined in claim 12, wherein said second pins are spring-prestressed against one end of said slots.

14. A pressing tool as defined in claim 10, wherein said first pins are formed on rockers.

15. A pressing tool as defined in claim 14, wherein said rockers have ends which are directed away from said first pins, said ends of said rockers being spring-supported in said pressing jaws.

16. A pressing tool as defined in claim 1, wherein two pressing jaws are connected to one another by an articulated manner.

* * * * *

UNITED STATES PATENT AND TRADEMARK OFFICE

CERTIFICATE OF CORRECTION

PATENT NO. : 6,772,618 B2
DATED : August 10, 2004
INVENTOR(S) : Egbert Frenken

It is certified that error appears in the above-identified patent and that said Letters Patent is hereby corrected as shown below:

Column 6,
Line 36, "openings 11" should be -- opening 18 --

Signed and Sealed this

Twenty-sixth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,772,618 B2
DATED : August 10, 2004
INVENTOR(S) : Egbert Frenken

It is certified that error appears in the above-identified patent and that said Letters Patent is hereby corrected as shown below:

Column 8,
Lines 57-58, "in particular ends of pipes laid for sanitary purposes," should have been deleted Signed and Sealed this Fifth Day of April, 2005

JON W. DUDAS
*Director of the United States Patent and Trademark Office*